US005373304A

United States Patent [19]

Nolan et al.

[11] Patent Number: 5,373,304

[45] Date of Patent: Dec. 13, 1994

[54] CELLULAR PHONE ANTENNA REFLECTOR

[76] Inventors: James F. Nolan, 14 Jet View Dr., Rochester, N.Y. 14624; Douglas A. Taylor, 399 Sagamore Dr., Rochester, N.Y. 14617

[21] Appl. No.: 68,926

[22] Filed: May 27, 1993

[51] Int. Cl.[5] ..... H01Q 1/24; H01Q 1/52

[52] U.S. Cl. ..... 343/841; 343/702; 455/89

[58] Field of Search ..... 343/702, 841, 790, 791, 343/872, 873; 455/89, 90, 347; H01Q 1/24, 1/52

[56] References Cited

U.S. PATENT DOCUMENTS

| | | | |
|---|---|---|---|
| 2,480,143 | 8/1949 | Lanxner | 343/841 |
| 3,564,111 | 2/1971 | Breitenbach | 343/841 |
| 4,189,730 | 2/1980 | Murdock | 343/841 |

*Primary Examiner*—Donald Hajec
*Assistant Examiner*—Hoanganh Le
*Attorney, Agent, or Firm*—James J. Ralabate

[57] ABSTRACT

The cellular phone antenna reflector of this invention has a tubular configuration. It is made up of three major components, an inner core, a shield and an outer component. The shield is made from a conductive material and encircles only a section of the inner core. The entire reflector of this invention is flexible and all of the components can be flexed for ease of use over an antenna.

7 Claims, 2 Drawing Sheets

CELLULAR PHONE ANTENNA REFLECTOR

This invention relates to an antenna reflector and, more specifically, to a novel antenna cover-reflector designed to protect the user from possible dangerous electromagnetic radiation.

BACKGROUND OF THE INVENTION

Cellular phones have been used extensively, specifically operating in the 825–896 megahertz band width. There is a great deal of concern today with the possibility that use of these cellular phones may present a dangerous cancer-causing environment for the user. The recent concern and publicity associated with this potential problem can seriously inhibit the use of cellular phones. While studies are continuing on this, many users and possible users could either limit or cease to use their cellular phones.

One possible solution to this dilemna is to provide a radio energy reflector designed to dramatically reduce electromagnetic radiation, i.e. radio frequency interference (RFI), electromagnetic interference (EMI) or electromagnetic field (EMF) from impinging on the user's body. There is a need for means to prevent absorption of EMF waves into the user's head which may cause biological changes that could lead to cancer development. Recent studies and occurrences have brought attention to the need to reflect radio energy at close proximity to the head or body away from the source so as to prevent the aforementioned trigger mechanism from occurring. Radio energy is comprised of electromagnetic energy with voltage and current components. The radio energy alternates its voltage and current at prescribed frequency in order to radiate from the antenna. Cellular phones transmit and receive radio energy in the spectrum of 825–896 megahertz. Direct and indirect evidence indicates that AC or radio wave electric and magnetic fields could increase the risks of cancers and other physiological and psychological abnormalities. The cause, although not fully understood, appears to occur when the magnetic and AC fields surrounding the body produce AC current inside the body. Theory developed to date suggests that the current interferes with the normal passthrough of ions through membranes of body cells. A threshhold level of AC current of five billionths of an ampere has also shown to increase protein production in cancer cells in preliminary tests. The above theory, evidence, and data regarding EMF danger provides a strong basis for the need to develop a user-friendly portable cellular phone antenna shield which deflects and reflects electromagnetic radiation away from the user.

SUMMARY OF THE INVENTION

It is therefore an object of this invention to provide a cellular phone antenna reflector which minimizes or prevents the above-noted problems.

Another object of this invention is to provide a cellular phone antenna reflector which is convenient and safe and effective to use.

Still another object of this invention is to provide a cellular phone antenna reflector that is simple in construction and relatively easy to manufacture.

Yet another object of this invention is to provide a cellular phone antenna reflector which can be universally used on a plurality of cellular phones.

Still yet another object of this invention is to provide a lightweight, flexible and safe antenna reflector for cellular phones that is comfortable to touch and use adjacent the user's head.

These and other objects of this invention are provided by a novel antenna shield comprised of a three-component inner apertured cylindrical or tubular configuration. The inner apertured core portion of the cylinder is comprised of an elastomeric foam having thermal insulation properties such as AP Armaflex or Armaflex II which are trademarks of Armstrong World Industries, Inc. of Lancaster, Pa. The closed cell structure of this inner core portion effectively retards the flow of moisture and is considered a low transmittance vapor barrier. A suitable thickness for this tubular component is about 7/16 inch. Obviously, it must be non-conductive, permit passage of electromagnetic radiation and be flexible in order to easily fit over the antenna. The main functions of this apertured core portion is to fit snuggly on the phone antenna; to keep the antenna centered within the antenna reflector so as to maintain a constant and appropriate distance between the shielding material and the phone antenna; to be flexible so as to easily bend with the phone antenna while maintaining the appropriate location on the phone antenna; to provide a good holding surface for the shielding material and to be lightweight and easily installed and removed from the phone antenna. Any suitable flexible lightweight core material may be used provided the above-stated function is accomplished. Foam core products that are insulating and made from polyurethanes, polycarbonates, polystyrene, vinyl-based polymers, polyacrylates or other flexible lightweight materials or mixtures thereof may be used, if suitable.

Surrounding and adjacent to at least a portion of the inner core structure is a flexible conductive material having a thickness of preferably from about 0.002 to 0.125 inches. This material is the reflecting material of the device of this invention and will effectively block or reflect electromagnetic radiation away from the user's head. A suitable material for this use is manufactured by Sauquoit Industries, Inc. of Scranton, Pa. Additional suitable conductive materials that can be used are as follows:

Flexshield TM, 8015 a trademark of Adhesives Research Inc., combines Flectron silver/copper nylon ripstop material and Adhesives Research's patented EC-2 homogeneously conductive adhesive to produce a highly versatile and effective shielding tape. It offers shielding properties approaching that of foil tapes but with conformability that allows it to be used in applications where foil tapes could not be used. The product is protected on one side by a siliconized kraft release liner and is available in rolls or sheets.

Flexshield TM 8016, also a trademark of Adhesives Research Inc., combines Flectron copper/nylon ripstop material and Adhesives Research's patented EC-2 homogeneously conductive adhesive to produce a highly versatile and effective shielding tape. It offers shielding properties approaching that of foil tapes but with conformability that allows it to be used in applications where foil tapes could not be used. The product is protected on one side by a siliconized craft release liner and is available in rolls or sheets.

The conductive material should not exceed a thickness of 0.125 because it could affect the overall flexibility and reflective properties of the entire unit and thicker materials would perform no additional useful function. Another equally suitable material is identified as P/N M3016-250-3 and is provided by Schlegel Corporation of Rochester, N.Y. These materials are generally ripstop nylon cloth which is plated on each individual thread before weaving. The plating on the individual threads is either copper or silver or a combination thereof. The weaving process takes plated thread in both directions in order to create a shield at the 825–896 megahertz band width. This conductive material may be adhered to the foamed core portion by any suitable means. While a silver or copper metallized conductive material is preferred for use as the shield portion of this device, any other suitable conductive material may be used. The criteria is that the conductive material act as a shield for electromagnetic energy of the type experienced with the use of cellular phones. Measurements of the effectiveness of the conductive shields of this invention can be easily made as illustrated in the examples using various meters which measure electric fields, magnetic fields and radio microwaves. One such meter or measuring device is Tektronics Model 2710 Spectrum Analyser provided by Tektronix Corp. of Beaverton, Oreg. The conductive plating of the shield silver metallized nylon fabric has tested to an average attenuation of 60 DbB from 30 MHz to 1 MHz.

The shielding material in this invention is designed to reflect the cellular telephone emitted radio waves in one direction from the antenna. The shield is developed to deflect the field strength attenuating the output field strength of the radio near the user's body. The shield is not an absorptive material thus allowing the reflected radio energy to be maximized in the uo to 180° sector opposite the user's body. This 180° sector with its predetermined distance from the EMF emitting antenna effectively deflects and reflects the radio waves which essentially travel in straight lines past the user's head when the phone is in use.

An alternative shielding material used in this device is manufactured by Sauquoit Industries, Inc., 300 Palm Street, P.O. Box 3807, Scranton, Pa. 18505 and is processed ripstop nylon cloth which is plated on each individual thread before weaving. The weaving process takes plated thread in both directions in order to create a shield at the high frequency band of 825–896 megahertz. The plating on the individual threads of ripstop cloth is either copper or silver or a combination of both. The Plating process is better with regards to the silver versus the copper and it appears that when copper plating it is best to cooper plate over the silver which causes better adherance to the thread. The number of plated threads per inch and the weight of the cloth has some bearing on the technical application for this product. It may be varied, however, from time to time in order to accommodate the procurement of the shielding material.

The third and exterior component of the shield of this invention preferably comprises a closed-cell neoprene foam sandwiched between Spandex material on one side and Lycra material on the other. A material found effective is a product identified as R-1400-N manufactured by Rubatex, Inc. of Bedford, Va. Various other materials may be used, if suitable, for this outer or exterior component. Typical materials would be polymers of neoprene, ethylene propylene terpolymer, nitrile (NBR), styrene-butadine, ethylene vinyl acetate, chlorinated polyethylene, vinyl materials such as PVC polyvinylchloride or mixtures thereof. The function of this exterior component is to be tight fitting so as to maintain the size and shape of the core and shielding materials, to be lightweight, to be flexible, to be durable, to be wear resistant, and to be attractive so as to compliment the cellular phone with the antenna reflector in place. Also, to permit the use of identification marks on this component such as a seam or notation or other marking to indicate the correct orientation of the antenna reflector to the cellular phone and the user's head. This marking could indicate either that it should be adjacent the user's head or could indicate this mark should be pointed away from user's head. This mark always orients the reflector so that the shield is adjacent the user's head. Any suitable material having this function may be used.

The structure of the flexible shield of this invention is critical to the present invention. The inner core component must contain an aperture sufficient to fit around the antenna of a conventional cellular phone such as those defined in U.S. Pat. Nos. 4,969,180; 5,020,092; 5,025,467: 5,109,403 or 5,109,403. A typical cellular phone having an antenna on which the present shield can be used is described in *Portable Cellular Telephone User Manual,* 68P09358A50-0 published in 1992 by Motorola, Inc. of Libertyville, Ill. Other typical cellular phones having antennas that can be covered with the shield of this invention are disclosed in *Cellular Buyer's Guide,* Volume 3 Number 1, Spring 1993 edition published by Curt Co. Publishing of Woodland Hills, Calif.

A second critical feature of this invention is that the second component or conductive material cover encircle at least a portion of the inner core component leaving a section of the inner core unshielded or uncovered. This is important so that the unshielded portion of the inner core be pointed away from the user's head while the shielded portion is adjacent to the user's head. The unshielded portion permits ready reception and transmission of the electromagnetic radiowaves while the shielded portion adjacent the user's head provides the protection from the radio energy transmitted thereto.

The soft configuration of all of the components prevents harmful injury. Electromagnetic propagation or power out of the transmitted signal is not altered except by direction. Reception signal sensitivity is not attenuated by the shield of this invention except by positioning or direction of the antenna reflector.

The following examples clearly illustrate the usefulness of the present invention.

EXAMPLE 1

This example indicates field tests that were conducted to show that the reception qualities of the cellular phone were not interferred with or diminished when the antenna reflector was in use on the cellular phone.

Several popular models of cellular phones were tested with and without the cellular phone antenna shield installed under a variety of normal operation conditions at distances from the cell between 1/8 and 5 miles as shown in chart below.

The combination of the cellular phone and the transmission /receiving cells have the combined ability to adjust automatically for signal strength. The signal strength indicators on the cellular phones tested become a good gauging device for the "in use" tests as shown below.

| | In Car | Outside | In Building |
|---|---|---|---|
| Moving | X | X | X |
| Stopped | X | X | X |

-continued

| | In Car | Outside | In Building |
|---|---|---|---|
| Under Bridges | X | X | |
| In Large Cities | X | X | X |
| In the Country | X | X | X |
| Full Charged Battery | X | X | X |
| Low Charge Battery | X | X | X |

All combinations of the above conditions were tested with cellular phones having signal strength indicators. A signal strength meter (SSM) available from Motorola was used in these tests but any appropriate meter can be used. The tests and the signal strength indicator readings indicated that there is no pattern of loss of transmission or reception quality with the cellular phone reflector in use. "X" indicates a test was made under that combined condition as shown.

EXAMPLE 2

Specific quantitative tests were conducted using a Tektronix Model 2710 Spectrum Analyser. Readings were taken to determine the reduction in Db readings between the unshielded antenna and the antenna with the antenna reflector installed. Since Db readings are relative and in this test case will be negative readings, we will then subtract the smaller negative number taken from the unshielded antenna from the larger negative number taken from the antenna with the antenna reflector installed. The difference beetween the two readings shown in Db reduction represents the shielding efficiency of the antenna reflector in the direction of the user's head. Using the tables in the *Handbook of Electronic Tables and Formulae* we then converted the Db reductions to percentage reductions. The most important reading in terms of effective shielding using the antenna reflector is the o° reading which is closest to and in a straight line between the cellular phone antenna and the user's head.

Db is short for Decibal which is a measurement increment for power level.

| Db Reading | | | Reduction | |
|---|---|---|---|---|
| Shielded | Unshielded | | Db | % |
| 90° 13.2 | 5.1 | = | 8.1 | 84.5 |
| 60° 14.1 | 5.8 | = | 8.3 | 85.2 |
| 30° 15.1 | 5.8 | = | 9.3 | 88.3 |
| 0° 16.6 | 5.8 | = | 10.8 | 91.7 |
| 30° 15.9 | 6.1 | = | 9.8 | 89.5 |
| 60° 15.9 | 6.4 | = | 9.5 | 89.5 |
| 90° 15.9 | 6.4 | = | 9.5 | 88.8 |
| Average: 15.2 | 5.9 | = | 9.3 | 88.3 |

The above readings and reductions illustrate the effectiveness of the cellular phone antenna reflector for shielding the user's head from the radiated RFI, EMI and EMF energy when using a cellular phone.

DESCRIPTION OF THE DRAWING AND THE PREFERRED EMBODIMENTS

Figure 1:
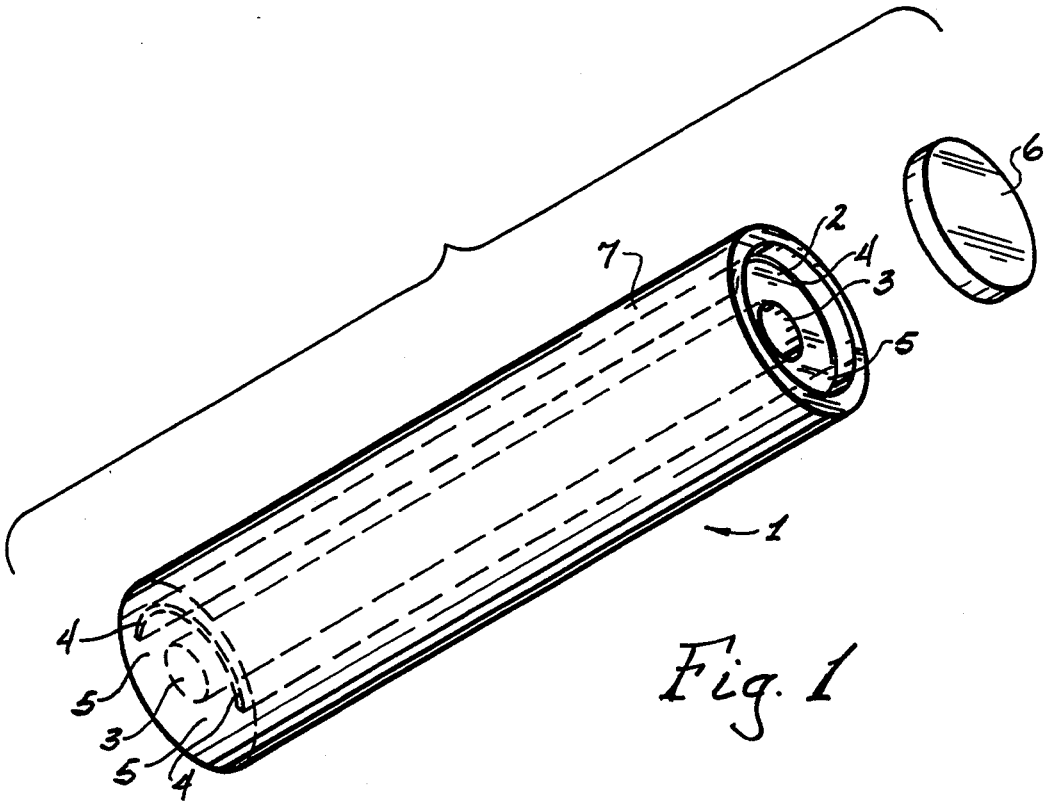
FIG. 1 is a perspective side view of the antenna reflector shield of this invention.
Figure 3:
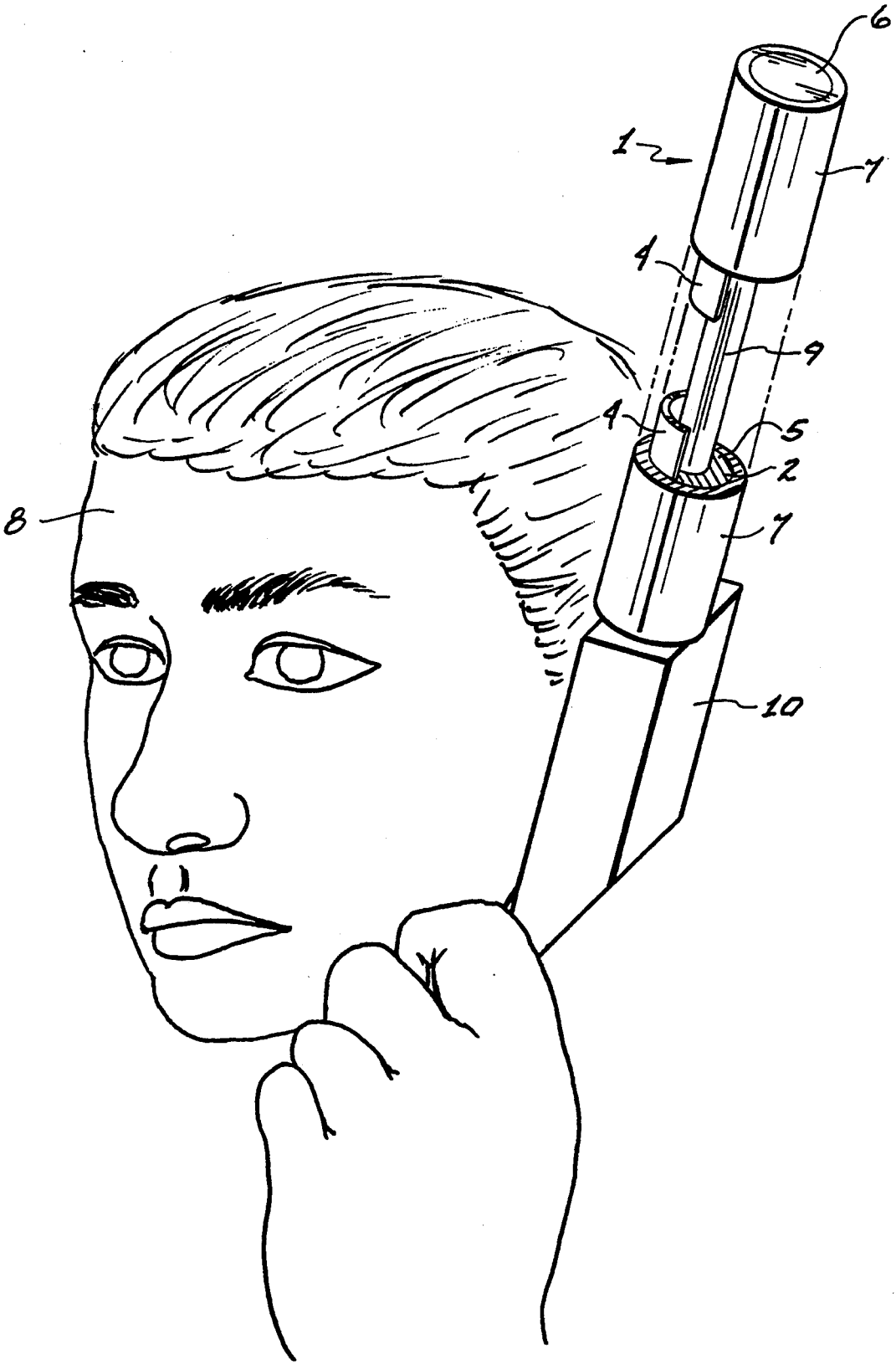
FIG. 3 is a perspective view of the shield of this invention as it is placed relative to the user's head.

In FIG. 1 the assembled tubular cellular phone antenna reflector 1 is illustrated having an elastomeric insulating inner core component 2. This apertured core component 2 must be constructed of a material which will not interfere with the reception of radio signals being transmitted to the user phone. This core component or foamed rubber tube 2 can be made from neoprene rubber such as the AP Armaflex material earlier discussed. It should be flexible enough to allow its central aperture 3 to fit snuggly around the antenna of the cellular phone. Also, it should be a soft foam comfortable for the user. In one embodiment this core component has a length of about 7.2 inches with an outside diameter of about 1 3/8 inches and an inside (aperture 3) diameter of about 3/8 inch. Wrapped around at least a portion of inner core component 2 is a conductive material 4 which acts as the shield of the cover or reflector 1. By "at least a portion" is meant to signify throughout this disclosure and claims that the conductive shield encircles the outer circumferential portion of inner core 2 to an extent sufficient to provide a shielding effect but leaving an open or unwrapped section 5 of core 2 which will permit access of the signal to and from the antenna. Thus, the shielded portion 4 of the reflector of this invention is always positioned close to the user's head (as indicated by a marking on exterior component 7) while open section 5 faces away from the user's head as shown in FIG. 3. The conductive material 4 may be any functional conductive material but it is preferred to use a silver and/or copper containing fabric. The thickness of the material 4 should not exceed about 0.125 inches because it could affect the overall flexibility and reflective properties of the entire unit and a thicker material would perform no useful function.

Figure 2:
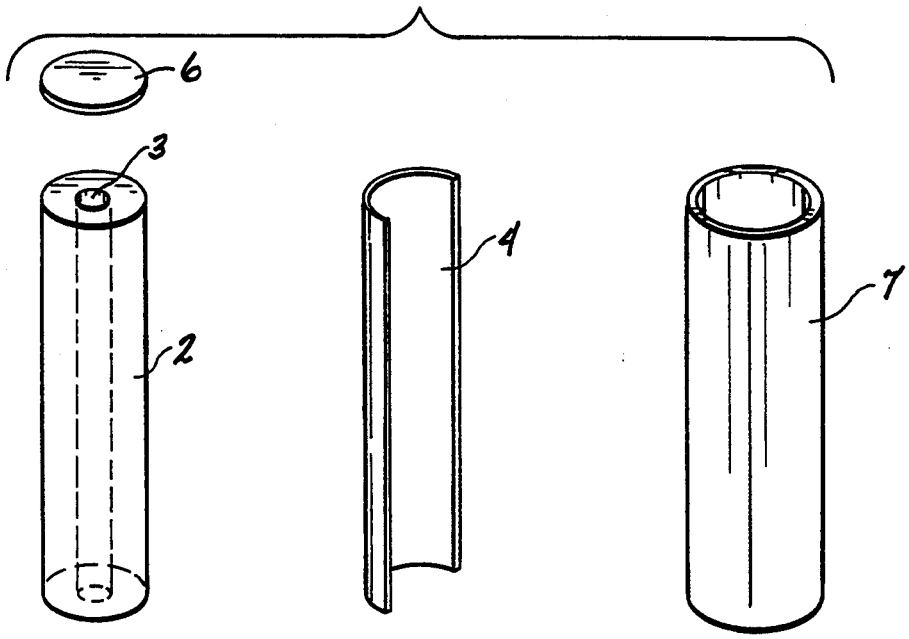
FIG. 2 is an exploded perspective side view of the three components of the shield of this invention.

It is preferred, for best results, that the material thickness be about 0.005 inches. The shield or conductive material 4 has an arc-like semi-tubular configuration as shown in FIG. 2 and extends throughout the entire length of reflector 1 thereby extending slightly beyond the length of the contained antenna. The shield 4 must be conductive because radio signals (RFI, EMI and EMF) reflect from conductive objects typical of radar targets. At the top of the reflector 1 is positioned a cap 6 which is made of the same material as exterior component 7. A material found to be desirable in the present invention is a closed cell rubber or plastic sheet such as a neoprene (CR)R-1400-N stock number made by Rubatex Corp. of Baltimore, Md. The function of this exterior covering or component 7 is to be tight fitting so as to maintain the size and shape of the core and shielding materials, to be lightweight, to be flexible, to be durable, to be wear resistant, to be attractive so as to compliment the cellular phone with the antenna reflector in place and to use the identification marks on this component to maintain correct orientation of the antenna reflector to the cellular phone and permit the shield 7 to be adjacent to the user's head. Obviously, other suitable exteriors may be used if they produce the same or equal above-noted function.

In FIG. 2 the reflector 1 of this invention is disassembled into component parts, inner core 2 with a central aperture 3, conductive material 4 and exterior covering 7. These components can be adhered together by any suitable means such as appropriate adhesives. It should be noted that the conductive material 4 is constructed so that it will not encircle the entire outer circumferential portion of inner core 2 and also is coextensive with the lengths of both inner core 2 and exterior covering 7. Exterior covering 7 can be wrapped around and adhered to substantially the entire outer portions of conductive fabric 4 and the exposed inner core circumferential portion by any suitable means. The conductive material shield 4 is constructed so that it wraps around a portion of inner core 2 leaving thereby an opening or unwrapped section 5 that permits reception and transmission of the electrical signal to and from the antenna. It is important that the thickness of exterior portion 7 should not exceed about 0.125 inches because it could affect the flexibility of the entire unit.

In FIG. 3 the location or positioning of the reflector 1 and shield 4 vis-a-vis the user head 8 is shown. The shield 4 is positioned nearest the user 8 and the position is identified by appropriate markings (such as the exterior material 7 seam) while unwrapped or open section 5 faces away from the user 8. Cap 6 covers the top portion of antenna 9 which is housed and completely covered by the reflector 1 inner core component 2. The cellular telephone 10 may be held in any manner provided the antenna 9 is covered in such a way that the shield 4 is closest to the user 8 and the position is identified by any appropriate marking means as earlier noted. Obviously, the portion of reflector 1 that will be adjacent the user's head 8 will be the exterior wrapping 7 which covers the shield 4 as it does the entire outer section of reflector 1.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A cellular phone antenna tubular reflector comprising in combination means for connection over a phone antenna and three distinct reflector components, an inner core component, a shield component and an outer component, said inner core component having a tubular configuration and constructed of a flexible material having a centrally positioned aperture which extends throughout substantially its entire length, said shield component having an arch-like semi-tubular configuration and constructed of a conductive fabric which abuts and is wrapped around a portion of the outer circumferential section of said inner core component, said shield component having a thickness of up to about 0.125 inches and co-extensive with and substantially equal to the length of said inner core component and said outer component, at least a portion of said circumferential section of said inner core component unwrapped by said shield component, said outer component having a tubular configuration and constructed of a flexible material and enclosing substantially all of said shield component and exposed surfaces of said inner core component.

2. The reflector of claim 1 wherein said outer component comprises a cap which covers substantially an entire top terminal portion of said tubular reflector.

3. The reflector of claim 1 wherein said shield is comprised of a conductive material comprising a composition selected from the group consisting of silver, copper and mixtures thereof.

4. The reflector of claim 1 wherein said outer component comprises a polymeric closed cell foam material.

5. The reflector of claim 1 wherein said inner core component comprises a centrally-positioned aperture which extends throughout the length of said inner core component, said inner core component being longer than a phone antenna upon which it will be used.

6. The reflector of claim 1 wherein said shield has a thickness of about 0.005 inches.

7. The reflector of claim 1 wherein the diameter said outer component is larger than the diameter of said inner component, said outer component having a centrally disposed opening sufficient to receive and house said inner component with said shield component wrapped partially around its outer circumferential section.

* * * * *